US008305170B2

(12) United States Patent
Koppmann et al.

(10) Patent No.: US 8,305,170 B2
(45) Date of Patent: Nov. 6, 2012

(54) ELECTROMAGNETIC SWITCHING DEVICE HAVING A PLURALITY OF AREAS GRADUATED RELATIVE TO ONE ANOTHER

(75) Inventors: Bardo Koppmann, Kaltenbrunn (DE); Peter Schlegl, Altdorf (DE); Norbert Zimmermann, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 134 days.

(21) Appl. No.: 12/672,107

(22) PCT Filed: Dec. 3, 2007

(86) PCT No.: PCT/EP2007/063179

§ 371 (c)(1),
(2), (4) Date: Feb. 4, 2010

(87) PCT Pub. No.: WO2009/018864

PCT Pub. Date: Feb. 12, 2009

(65) Prior Publication Data

US 2011/0205003 A1 Aug. 25, 2011

(30) Foreign Application Priority Data

Aug. 7, 2007 (EP) ..... 07015519

(51) Int. Cl.
*H01H 9/02* (2006.01)
*H01H 13/04* (2006.01)

(52) U.S. Cl. ..... 335/202; 335/132; 335/106

(58) Field of Classification Search ..... 335/202, 335/6–46, 106–137
See application file for complete search history.

(56) References Cited

U.S. PATENT DOCUMENTS 3,105,128 A * 9/1963 Deissler ..... 335/121
(Continued)

FOREIGN PATENT DOCUMENTS

DE 30 17 561 A1 11/1981
(Continued)

OTHER PUBLICATIONS

Office Action dated Jun. 5, 2012 for corresponding Chinese Patent Application No. 200780100145.7.

*Primary Examiner* — Mohamad Musleh
(74) *Attorney, Agent, or Firm* — Harness, Dickey & Pierce, P.L.C.

(57) ABSTRACT

An embodiment of the present invention discloses an electromagnetic switching device including a housing including a mounting side and a connector side opposite the mounting side. The connector side includes one first and second main connection area for connecting first and second main lines to first and second fixed main contacts disposed in the interior of the housing. In the interior of the housing, movable main contact bridges are disposed via which one main current path each main current path includes one of the first fixed main contacts, one of the second fixed main contacts, and one of the main contact bridges. The main connection areas are located opposite one another. One first and one second central area are disposed between the main connection areas. The central areas each extend from the first to the second main connection area. The central areas are elevated relative to the main connection areas and disposed next to one another viewed from the first to the second main connection area. The first central area is more elevated relative to the main connection areas than the second central area.

19 Claims, 4 Drawing Sheets

U.S. PATENT DOCUMENTS

| | | | | |
|---|---|---|---|---|
| 3,238,329 | A * | 3/1966 | Russo | 335/131 |
| 3,251,964 | A * | 5/1966 | Lawrence et al. | 335/131 |
| 3,287,521 | A * | 11/1966 | Gryctko et al. | 337/146 |
| 4,281,305 | A * | 7/1981 | Weeks | 335/132 |
| 4,345,225 | A * | 8/1982 | Lemmer | 335/132 |
| 4,979,634 | A * | 12/1990 | Begley | 220/242 |
| 5,012,215 | A * | 4/1991 | Floc'h | 335/132 |
| 5,539,168 | A * | 7/1996 | Linzenich | 200/303 |
| 6,512,433 | B1 | 1/2003 | Bouchard et al. | |
| 7,612,972 | B2 * | 11/2009 | Battani et al. | 361/42 |
| 7,679,477 | B2 * | 3/2010 | Portier | 335/132 |
| 2004/0218317 | A1 * | 11/2004 | Kawazu et al. | 361/1 |
| 2008/0150660 | A1 * | 6/2008 | Birzer et al. | 335/106 |

FOREIGN PATENT DOCUMENTS

| | | | |
|---|---|---|---|
| DE | 10224976 | B4 | 12/2005 |
| EP | 0768727 | A1 | 4/1997 |
| EP | 1181704 | B1 | 4/2003 |
| FR | 2793948 | A1 | 11/2000 |
| FR | 2830677 | A1 | 4/2003 |
| WO | WO 2007023062 | A1 * | 3/2007 |

* cited by examiner

ELECTROMAGNETIC SWITCHING DEVICE HAVING A PLURALITY OF AREAS GRADUATED RELATIVE TO ONE ANOTHER

PRIORITY STATEMENT

This application is the national phase under 35 U.S.C. §371 of PCT International Application No. PCT/EP2007/063179 which has an International filing date of Dec. 3, 2007, which designates the United States of America, and which claims priority on European patent application number EP07015519 filed Aug. 7, 2007, the entire contents of each of which are hereby incorporated herein by reference.

FIELD

At least one embodiment of the present invention generally relates to an electromagnetic switching device. In particular, at least one embodiment relates to an electromagnetic switching device,

- wherein the electromagnetic switching device comprises a housing having a mounting side and a connecting side opposite the mounting side,
- wherein the connecting side has a first main connecting area for connecting first main conductors to first fixed main contacts arranged in the interior of the housing,
- wherein the connecting side has a second main connecting area for connecting second main conductors to second fixed main contacts arranged in the interior of the housing,
- wherein movable main contact bridges are arranged in the interior of the housing, by means of which one main current path respectively may be switched,
- wherein each main current path includes one of the first fixed main contacts, one of the second fixed main contacts and one of the main contact bridges, and/or
- wherein the first and second main connecting areas oppose each other.

BACKGROUND

Electromagnetic switching devices—for example in the form of contactors, power relays and electromechanical power switches—are very common. Purely by way of example reference is made to EP 1 181 704 B1 from which a corresponding contactor is known. Reference is also made purely by way of example to DE 102 24 976 B4 from which a corresponding power switch is known.

When wiring an electromagnetic switching device, various conductors are connected to the switching device. The conductors to be connected include at least the main conductors, which are switched by way of the switching device. Auxiliary conductors are also connected in many cases and these report the switching state of the switching device to a higher-order controller. Control conductors for actuating the switching device are also connected in many cases. Owing to the large number of conductors to be connected the allocation of the individual conductors to the corresponding connectors of the switching device is often unclear to the operator.

Various solutions are known for the physical arrangement of the various connectors. Thus for example it is known to provide connectors that are disposed directly side by side. It is also known to connect the main and control conductors in two different planes. The main conductors can be located upstream of the control conductors or downstream of the control conductors in this case. It is also known to connect main, auxiliary and control conductors in three different planes. In this case the main conductors are located downstream of the auxiliary conductors but upstream of the control conductors. It is also known to connect the main conductors to the switching device in one plane and the auxiliary and control conductors in another plane. In this case the main conductors are located downstream of the auxiliary and control conductors. Finally it is known to connect the main and auxiliary conductors in a first plane and the control wires in a second plane. The main and auxiliary conductors are located downstream of the control conductors in this case.

In many cases extra modules can also be fitted to the switching device. For a compact design in particular such extra modules are often integrated in the enveloping contour of the switching device. Extra modules that are integrated in the switching device or its enveloping contour can either only be disassembled using additional tools or are no longer readily accessible once the electromagnetic switching device is assembled, however.

SUMMARY

At least one embodiment of the present invention is directed to developing an electromagnetic switching device in such a way that the ease of connection and use are increased.

The inventive electromagnetic switching device of at least one embodiment proceeds from an electromagnetic switching device of the type described above. According to at least one embodiment of the invention, first and second central areas are arranged between the first and second main connecting areas. The first and second central areas each extend from the first to the second main connecting area. They are elevated with respect to the main connecting areas and, viewed from the first to the second main connecting area, are arranged side by side. The first central area is more elevated above the main connecting areas than the second central area.

With the inventive electromagnetic switching device of at least one embodiment it is for example possible that

- one of the central areas serves as an auxiliary connecting area for connecting auxiliary conductors to fixed auxiliary contacts arranged in the interior of the housing and as a control connecting area for connecting control conductors to a control circuit arranged in the interior of the housing,
- at least one movable auxiliary contact bridge is arranged in the interior of the housing,
- an auxiliary current path, which includes two of the auxiliary contacts and the respective auxiliary contact bridge, may be switched by means of any auxiliary contact bridge, and
- the auxiliary contact bridges and the main contact bridges are coupled to each other in such a way that the auxiliary current paths are switched together with the main current paths.

This results in a clear, intuitively recognizable allocation of the individual connecting areas to the corresponding conductors. The risk of incorrect wiring is reduced thereby.

Alternatively or additionally it is possible for the second central area to have a receiver for an extra module and for the receiver to have additional electrical contacts for electrically connecting the extra module to a circuit arranged in the interior of the housing. In this case the extra module can, for example, project beyond the second central area and therefore be removed without tools. However, it is not necessary for the extra module to project beyond the first central area and therewith the electromagnetic switching device as a whole.

A cable duct extending from the first to the second main connecting area is preferably arranged between the first and second central areas. This embodiment means that it is not necessary to guide wires across the central areas.

The second central area and the cable duct can be covered by a removable cover. When covering the second central area and cable duct, the removable cover preferably adjoins the first central area at the same level.

The cover can be designed as a pivotal flap. In this case the flap can preferably be pivoted about a pivot axis which is arranged at an end of the second central area that is remote from the first central area.

BRIEF DESCRIPTION OF THE DRAWINGS

Further advantages and details emerge from the following description of an example embodiment in connection with drawings. In schematic diagrams.

DETAILED DESCRIPTION OF THE EXAMPLE EMBODIMENTS

The main features of an embodiment of the present invention will firstly be described in more detail with reference to FIG. 1. By way of addition FIG. 2 should also be consulted in part.

Figure 1:
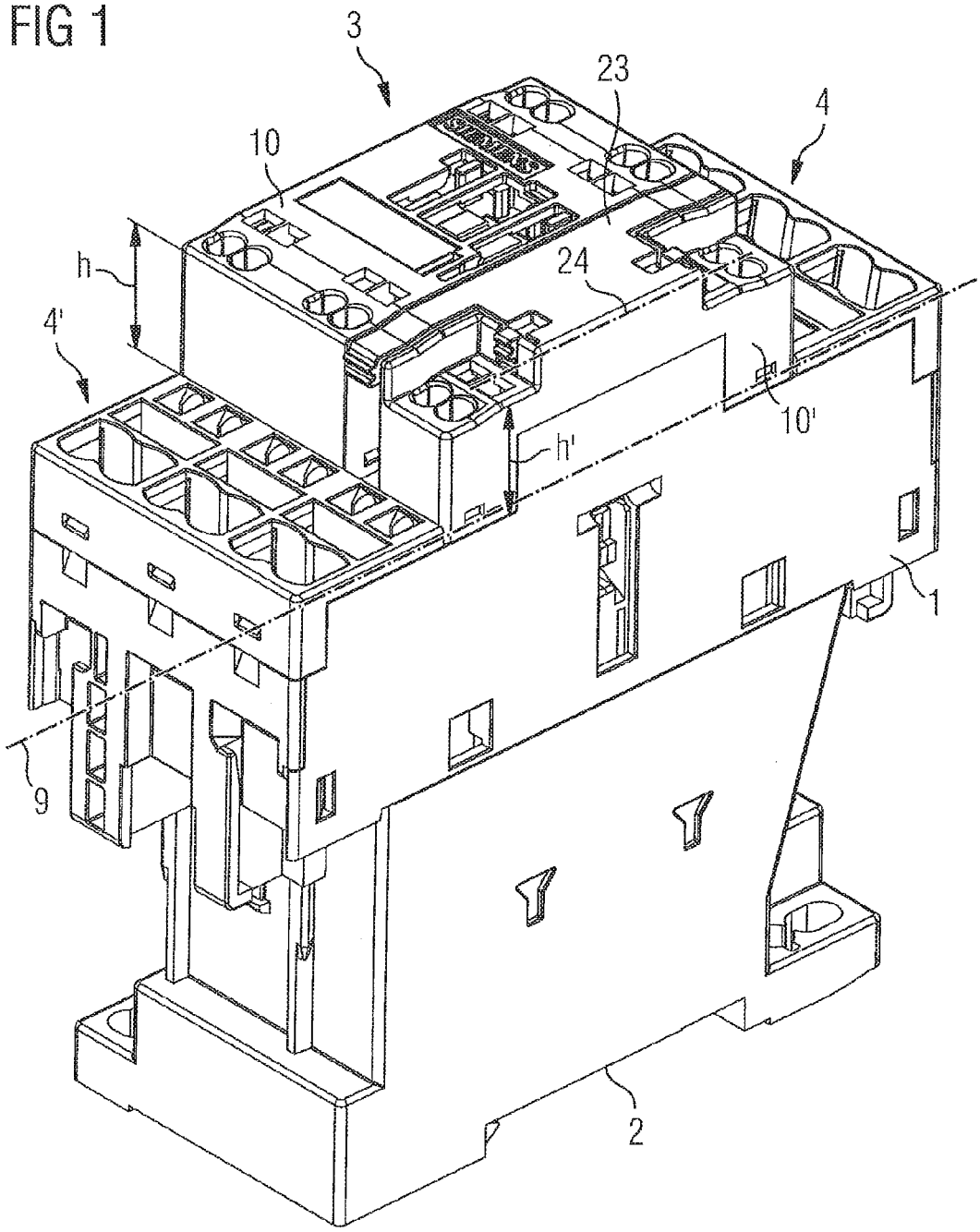
FIG. 1 shows a perspective view of the mechanical construction of an inventive electromagnetic switching device, FIG. 2 schematically shows an electrical block diagram of the electromagnetic switching device of FIG. 1.

According to FIG. 1 an electromagnetic switching device includes a housing 1. The housing 1 includes electrically insulating material, as a rule of plastics material. It encapsulates electrical or electronic components arranged in the interior of the housing 1 in a predefined protection category, usually IP 20. The housing 1 in particular comprises a mounting side 2 and a connecting side 3 opposite the mounting side 2. The electromagnetic switching device can be mounted, for example, on a wall of a switch cabinet, for example latched thereon, by way of mounting side 2.

The connecting side 3 has a first main connecting area 4. According to FIG. 2 first main conductors 5 can be connected to first fixed main contacts 6 across the first main connecting area 4. The main contacts 6 are arranged in the interior of the housing 1 in this connection according to FIG. 2. The number of first main contacts 6 is usually between three and five.

The connecting side 3 also has a second main connecting area 4'. Second main conductors 5' can be connected to second fixed main contacts 6' across the second main connecting area 4'. The second main contacts 6' are also arranged in the interior of the housing 1 here (see FIG. 2). Their number corresponds with the number of first main contacts 6.

Figure 2:
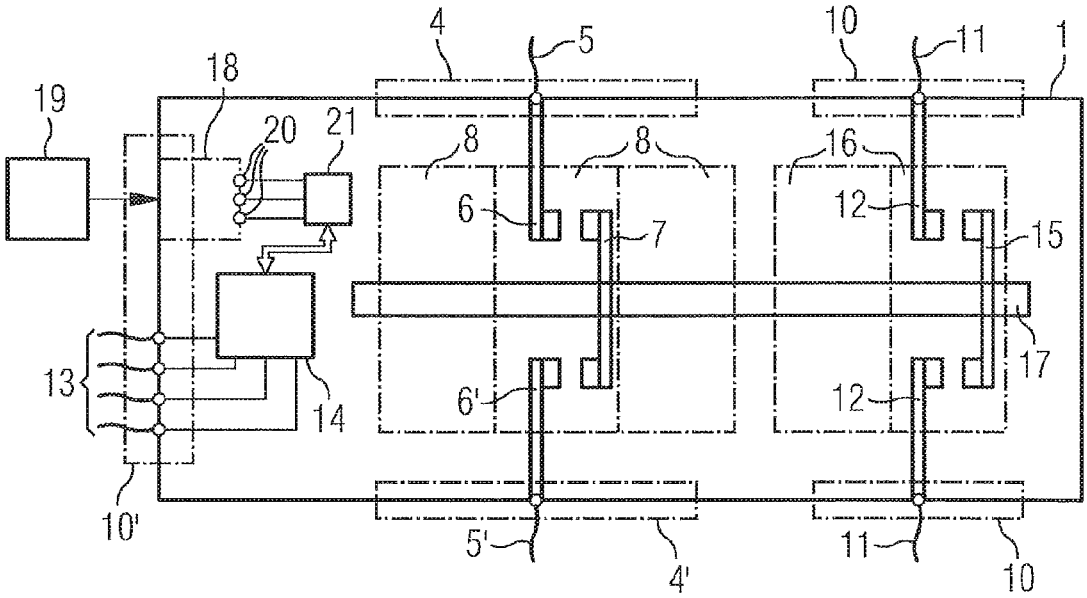

Movable main contact bridges 7 are also arranged in the interior of the housing 1. One main current path 8 respectively may be switched by means of the main contact bridges 7. Each main current path 8 includes one of the first fixed main contacts 6, one of the second fixed main contacts 6' and one of the main contact bridges 7. For reasons of clarity FIG. 2 shows in detail only one main current path 8 with its main contacts 6, 6' and its contact bridge 7.

According to FIG. 1 the first and second main connecting areas 4, 4', based on the connecting side 3, oppose each other. As a rule they are arranged at the same level—compare a line 9 in FIG. 1. However, it would be possible for one of the main areas 4, 4' to be elevated over the respective other main contact area 4, 4'.

First and second central areas 10, 10' are arranged between the first and second main connecting areas 4, 4'. The first and second central areas 10, 10' each extend from the first to the second main connecting area 4, 4'. They are elevated with respect to the main connecting areas 4, 4'. The first central area 10 is more elevated above the main connecting areas 4, 4' than the second central area 10'. A spacing h of the first central area 10 from the main connecting areas 4, 4' is therefore greater than a spacing h' of the second central area 10' from the main connecting areas 4, 4'. This applies—viewed from the main connecting area 4 to the main connecting area 4'—across the entire extension of the central areas 10, 10'. The central areas 10, 10' are also arranged side by side, viewed from the first to the second main connecting area 4, 4'.

The inventive embodiment of the electromagnetic switching device can be used in various ways. By way of example it is possible for one of the central areas 10, 10' to serve as an auxiliary connecting area for connecting auxiliary conductors 11 to fixed auxiliary contacts 12. The auxiliary contacts 12 are arranged in the interior of the housing 1 in this connection (see FIG. 2). The second of the central areas 10, 10' serves as a control connecting area in this case for connecting control conductors 13 to a control circuit 14 (see FIG. 2 again). The control circuit 14 is also arranged in the interior of the housing 1 in this connection.

According to FIG. 2 the first central area 10 serves as an auxiliary connecting area, the second central area 10' as a control connecting area. Alternatively however a reversed allocation could also exist. The control wires 13 may be easily connected irrespective of which of the central areas 10, 10' serves as the control connecting area. This applies regardless of the rest of the wiring of the electromagnetic switching device. In contrast to the prior art, connection possibilities for the control conductors 13, which are between the mounting side 2 and the connecting side 3 on the housing 1, are not necessary.

In the case of the embodiment of the central areas 10, 10' as an auxiliary connecting area and as a control connecting area, according to FIG. 2 one moveable auxiliary contact bridge 15 respectively is arranged in the interior of the housing 1 per pair of fixed auxiliary contacts 12. One auxiliary current path 16, which includes the two respective auxiliary contacts 12 and the respective auxiliary contact bridge 15, may be switched by means of any auxiliary contact bridge 15. The number of auxiliary current paths 16 is usually one or two. For reasons of clarity, analogously to the main current paths 8, FIG. 2 shows only one of the auxiliary current paths 16 in detail.

The auxiliary contact bridges 15 and the main contact bridges 7 are coupled to each other in such a way that the auxiliary current paths 16 are switched together with the main current paths 8. This can be achieved for example by providing a common contact bridge carrier 17 which moves the main contacts bridges 7 and the auxiliary contact bridges 15 together.

The presence of auxiliary conductors 11 and control conductors 13 is expedient in particular if the electromagnetic switching device is constructed as a contactor, power relay or electrical bidirectionally switchable electromechanical power switch.

Figure 5:
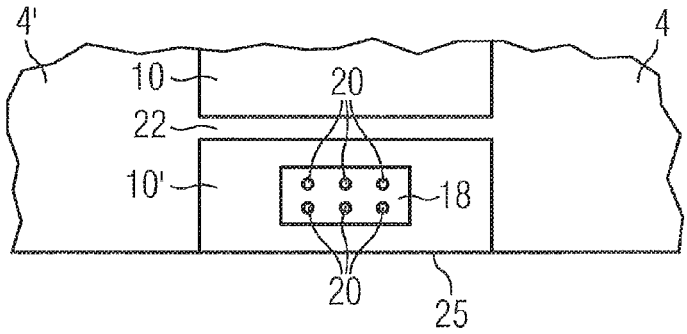
FIG. 4 shows the detail of FIG. 3 and an extra module and FIG. 5 shows a plan view of the detail of FIG. 3.
Figure 3:
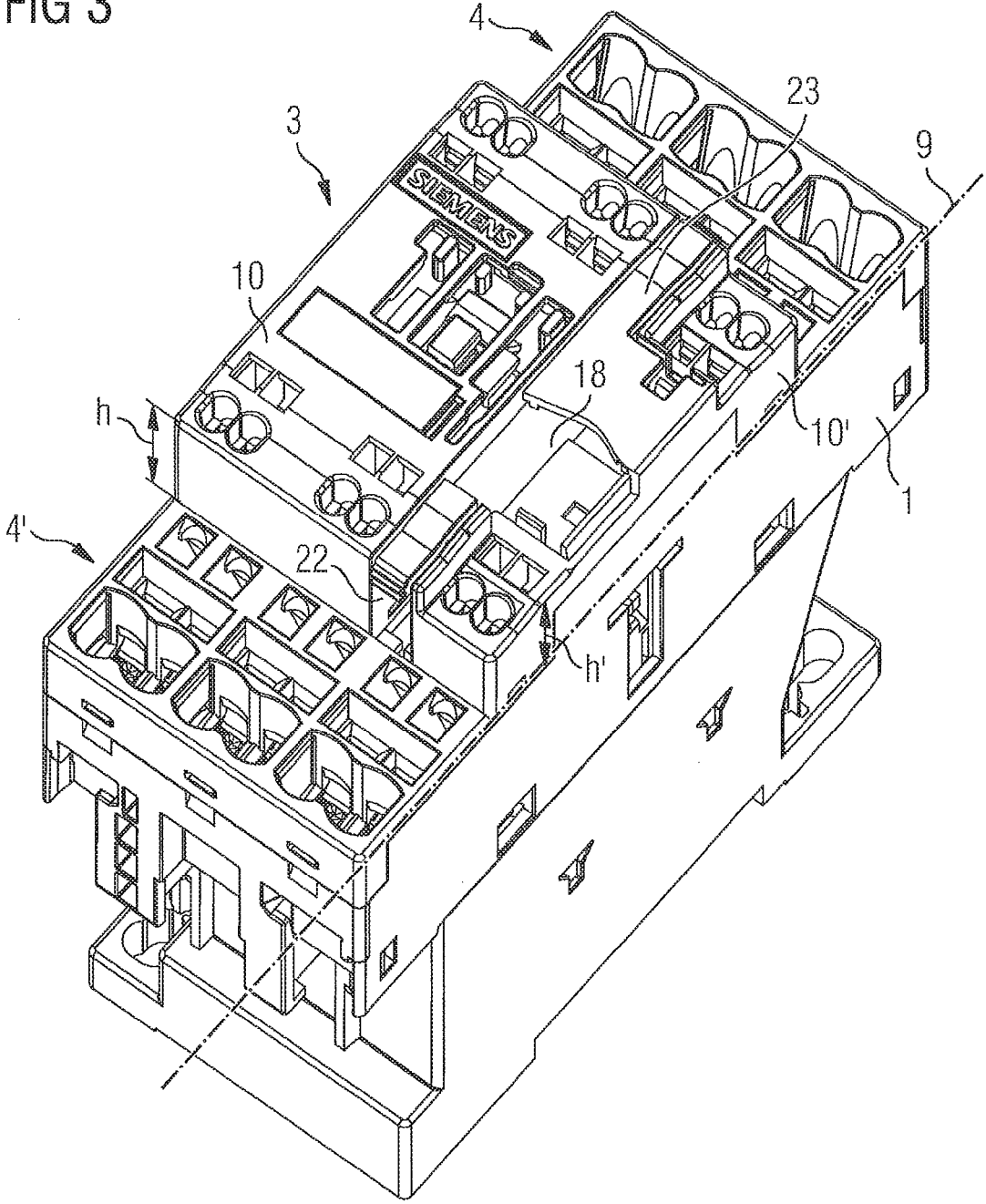
FIG. 3 shows a detail of FIG. 1.
Figure 4:
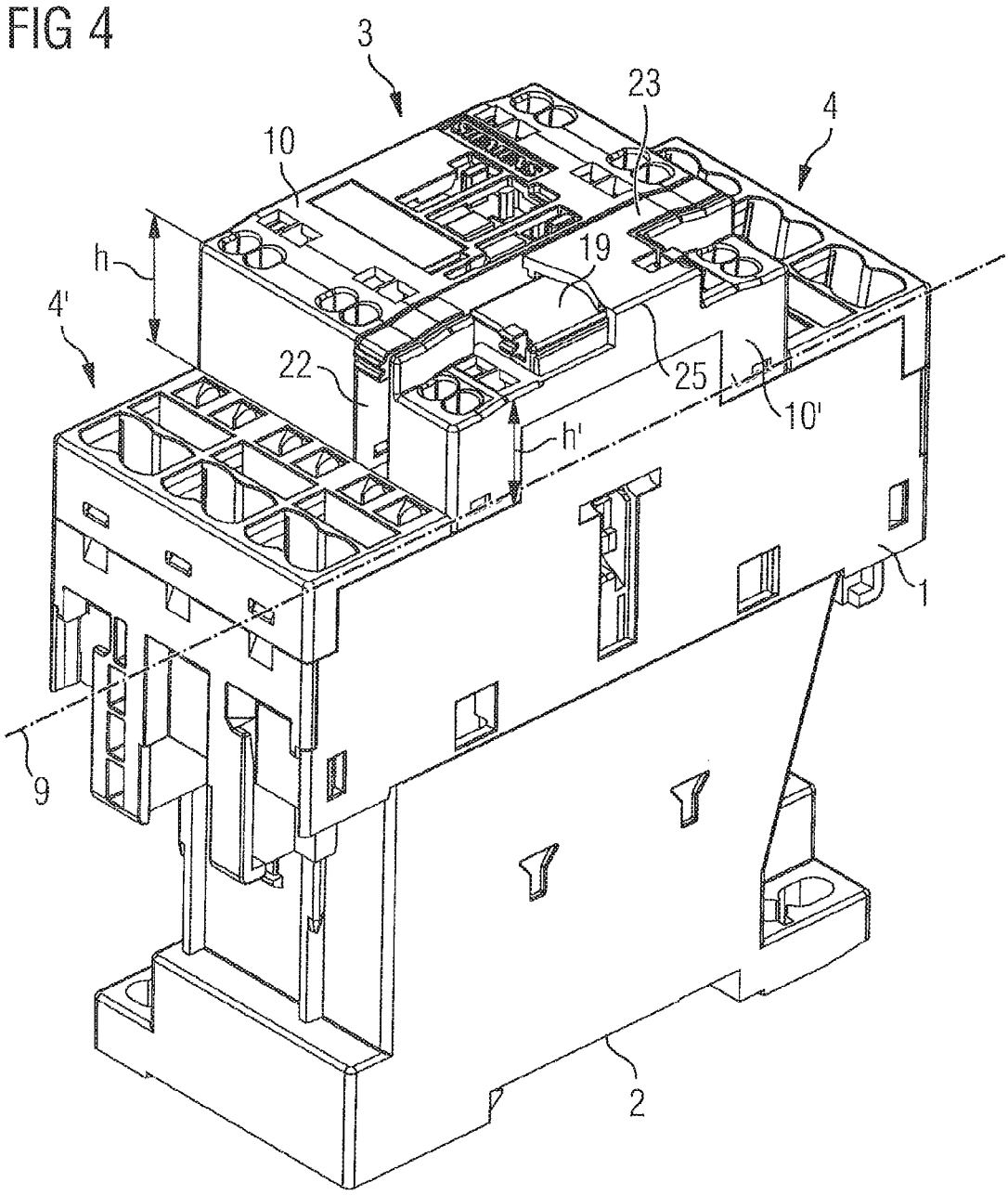

As an alternative or, preferably, in addition, to the presence of auxiliary conductors 11 and control conductors 13, it is possible for the second central area 10' to have a receiver 18 (see FIG. 3). In this case it is possible to insert an extra module 19 in the receiver 18 (see FIG. 4). In this case the receiver 18 has additional electrical contacts 20 (see FIG. 5). The extra module 19 can be connected to a circuit 21 arranged in the interior of the housing 1 by way of the additional electrical contacts 20 (see FIG. 2). The number of additional contacts 20 can be selected as required here. The extra module 19 can project beyond the second central area 10' when inserted in the receiver 18. It is therefore possible for an operator to grasp the extra module 19 with his fingers and remove it from the receiver 18. A tool is not required for this purpose.

One example of an extra module 19 is an overvoltage limiter. In this case the extra module 19 contacts two additional contacts 20 which overlap a control circuit drive coil. In this embodiment the extra module 19 limits a voltage pulse which strikes when the drive coil is disconnected.

In an example embodiment of the electromagnetic switching device a cable duct 22 is arranged between the first and the second central areas 10, 10'. The cable duct 22 extends from the first to the second main area 4, 4'. The presence of the cable duct 22 is not imperative, however. Alternatively the central areas 10, 10' can adjoin one another directly.

The depth of the cable duct 22 can be selected as required. As a rule the cable duct 22 extends at the same level as the main connecting areas 4, 4'. If the main connecting areas 4, 4' have different levels, the cable duct 22 can alternatively be sloped or extend at the level of one of the two main connecting areas 4, 4'.

The cable duct 22 and the second central area 10' are preferably covered by a cover 23. The cover 23 can be removed in this case.

The cover 23 can, for example, be designed as a pivotal flap. In this case the flap 23 can preferably be pivoted about a pivot axis 24 which is arranged at an end 25 of the second central area 10' that is remote from the first central area 10 (see FIG. 5).

The flap 23 can end below the first central area 10. As a rule it does not project beyond the first central area 10. When covering the second central area 10' and cable duct 22, it preferably adjoins the first central area 10 at the same level.

The inventive electronic switching device forms a constructional unit. With the exception of the extra module 19 and the various conductors 5, 5', 11, 13 and possibly the cover 23, individual components can only be removed by opening the housing 1. The protection provided by the housing 1 is relinquished hereby. If, purely by way of example, housing parts, which form the central areas 10, 10', are removed, electrical components located therebelow (for example the connections for the auxiliary and control conductors 11, 13) are freely accessible (protection category IP00).

The inventive electromagnetic switching device has many advantages:

For example there is a gradation of the connecting areas 4, 4', 10, 10' inside the electromagnetic switching device. A differentiation is made with respect to the functionalities as a result. Clarity is increased and the probability of incorrect wiring is reduced.

The gradation of the individual areas 4, 4', 10, 10' also allows integration of extra modules 19 in a manner in which visual inspection with regard to the fitted state is easily possible at any time. It is nevertheless possible to disassemble the extra module 19 without tools because the extra module 19 can project beyond the second central area 10' without projecting beyond the electromagnetic switching device as a whole.

The drawbacks in accessibility or in the clear arrangement of the electromagnetic switching device, which always exist to a certain extent in the prior art, are avoided. The, as a rule, larger main conductors 5, 5' can also be connected before the auxiliary conductors 11 and control conductors 13.

The inventive electromagnetic switching device combines all advantages with regard to clear arrangement by way of the differentiation into three different connection levels. A compact design is nevertheless achieved.

The above description serves solely to explain the present invention. The scope of the present invention shall be determined solely by the accompanying claims, however.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic switching device, comprising:

a housing including, a mounting side, a connecting side opposite the mounting side, the connecting side including, a first main connecting area for connecting first main conductors to first fixed main contacts arranged in an interior of the housing, and a second main connecting area for connecting second main conductors to second fixed main contacts arranged in the interior of the housing, the first and second main connecting areas opposing each other, and movable main contact bridges, arranged in the interior of the housing, each to respectively switch one main current path, each main current path including one of the first fixed main contacts, one of the second fixed main contacts and one of the main contact bridges, wherein first and second central areas are arranged between the first and second main connecting areas, the first and second central areas, each extending from the first to the second main connecting areas, are elevated with respect to the main connecting areas and, viewed from the first to the second main connecting area, are arranged side by side, the entire first central area is relatively more elevated above the main connecting areas than the entire second central area.

2. The electromagnetic switching device as claimed in claim 1, wherein one of the central areas is an auxiliary connecting area for connecting auxiliary conductors to fixed auxiliary contacts arranged in the interior of the housing and the other central area as a control connecting area for connecting control conductors to a control circuit arranged in the interior of the housing, at least one movable auxiliary contact bridge is arranged in the interior of the housing, an auxiliary current path, which includes two of the auxiliary contacts and the respective auxiliary contact bridge, is configured to be switched by way of any auxiliary contact bridge, and the auxiliary contact bridges and the main contact bridges are coupled to each other in such a way that the auxiliary current paths are switched together with the main current paths.

3. The electromagnetic switching device as claimed in claim 1, wherein the second central area includes a receiver for an extra module, and wherein the receiver includes additional electrical contacts for electrically connecting the extra module to a circuit arranged in the interior of the housing.

4. The electromagnetic switching device as claimed in claim 1, wherein a cable duct extending from the first to the second main connecting area is arranged between the first and second central areas.

5. The electromagnetic switching device as claimed in claim 4, wherein the second central area and the cable duct are covered by a removable cover.

6. The electromagnetic switching device as claimed in claim 5, wherein, when covering the second central area and cable duct, the removable cover adjoins the first central area at the same level.

7. The electromagnetic switching device as claimed in claim 5, wherein the cover is designed as a pivotal flap.

8. The electromagnetic switching device as claimed in claim 7, wherein the flap is pivotable about a pivot axis which is arranged at an end of the second central area that is remote from the first central area.

9. The electromagnetic switching device as claimed in claim 2, wherein the second central area includes a receiver for an extra module, and wherein the receiver includes additional electrical contacts for electrically connecting the extra module to a circuit arranged in the interior of the housing.

10. The electromagnetic switching device as claimed in claim 9, wherein a cable duct extending from the first to the second main connecting area is arranged between the first and second central areas.

11. The electromagnetic switching device as claimed in claim 10, wherein the second central area and the cable duct are covered by a removable cover.

12. The electromagnetic switching device as claimed in claim 11, wherein, when covering the second central area and cable duct, the removable cover adjoins the first central area at the same level.

13. The electromagnetic switching device as claimed in claim 6, wherein the cover is designed as a pivotal flap.

14. The electromagnetic switching device as claimed in claim 11, wherein the cover is designed as a pivotal flap.

15. The electromagnetic switching device as claimed in claim 12, wherein the cover is designed as a pivotal flap.

16. The electromagnetic switching device as claimed in claim 13, wherein the flap is pivotable about a pivot axis which is arranged at an end of the second central area that is remote from the first central area.

17. The electromagnetic switching device as claimed in claim 14, wherein the flap is pivotable about a pivot axis which is arranged at an end of the second central area that is remote from the first central area.

18. The electromagnetic switching device as claimed in claim 15, wherein the flap is pivotable about a pivot axis which is arranged at an end of the second central area that is remote from the first central area.

19. The electromagnetic switching device as claimed in claim 1, wherein the first and second central areas are nonadjoining.

* * * * *